US005396718A

United States Patent [19]

Schuler et al.

[11] Patent Number: 5,396,718

[45] Date of Patent: Mar. 14, 1995

[54] ADJUSTABLE INTERNAL ENERGY RETURN SYSTEM FOR SHOES

[76] Inventors: Lawrence J. Schuler, 4630 Middletown Rd., Canfield, Ohio 44406; Mark E. Johns, 2291 Water Edge, Columbus, Ohio 43209

[21] Appl. No.: 103,543

[22] Filed: Aug. 9, 1993

[51] Int. Cl.[6] ..... A43B 21/30; A43B 13/28

[52] U.S. Cl. ..... 36/38; 36/27

[58] Field of Search ..... 36/27, 28, 37, 38, 7.8, 36/58.6, 35 R, 114

[56] References Cited

U.S. PATENT DOCUMENTS

| | | | |
|---|---|---|---|
| 1,625,048 | 4/1927 | Rock | 36/38 |
| 2,508,318 | 5/1950 | Wallach | 36/38 |
| 2,555,654 | 6/1951 | Ostrom | 36/38 |
| 3,777,374 | 12/1973 | Hendricks | 36/38 |
| 3,810,318 | 5/1974 | Epstein | 36/90 |
| 4,492,046 | 1/1985 | Kosova | 36/27 |
| 4,546,555 | 10/1985 | Spademan | 36/28 |
| 4,592,153 | 6/1986 | Jacinto | 36/38 |
| 5,187,883 | 2/1993 | Penney | 36/27 X |
| 5,311,678 | 5/1994 | Spademan | 36/28 X |

FOREIGN PATENT DOCUMENTS

| | | | |
|---|---|---|---|
| 2200030 | 7/1988 | United Kingdom | 36/27 |

*Primary Examiner*—Paul T. Sewell
*Assistant Examiner*—BethAnne C. Cicconi
*Attorney, Agent, or Firm*—Harpman & Harpman

[57] ABSTRACT

An adjustable internal energy return system for use in running shoes and the like to provide an energy storage and release mechanism in the heel portion of the running shoe. The energy return system utilizes a tension adjustment strap to increase the base tension of a resilient carriage by providing additional resiliency. The tension adjustment strap is an additional independent energy return mechanism to the resilient carriage.

5 Claims, 3 Drawing Sheets

FIG. 1
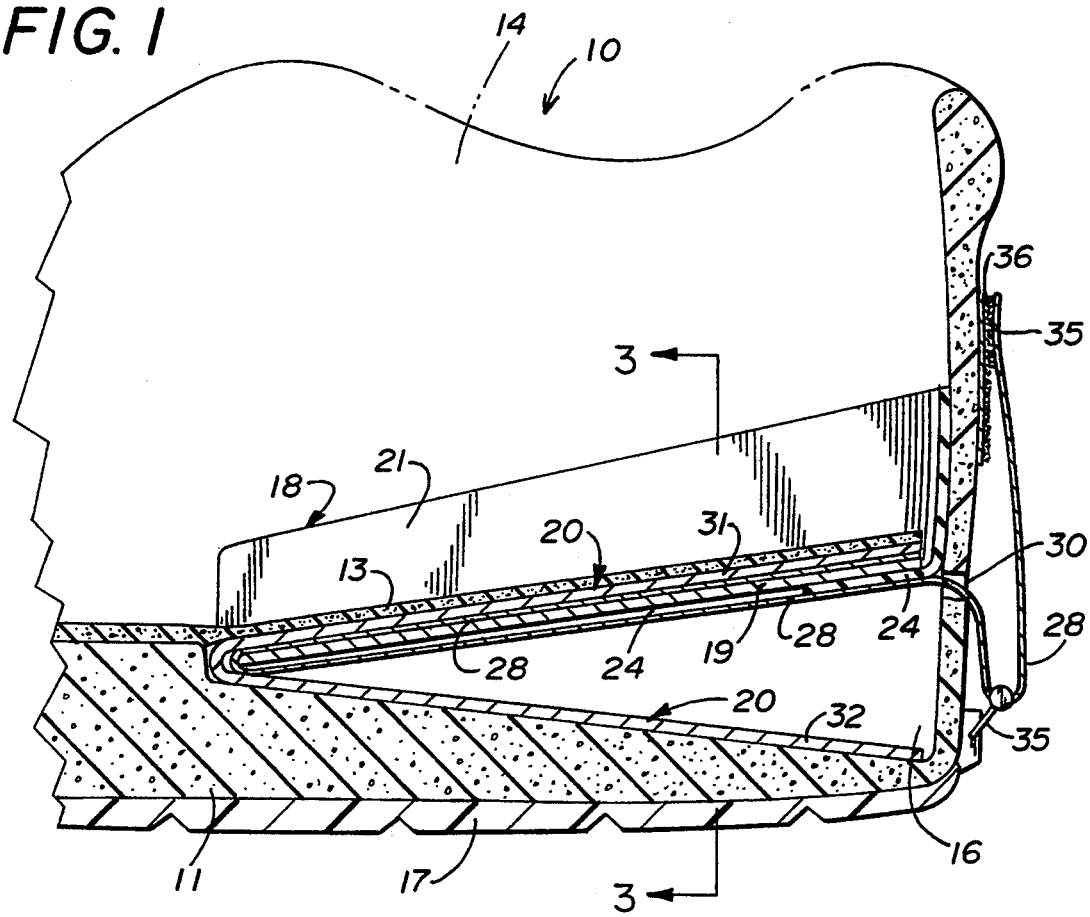
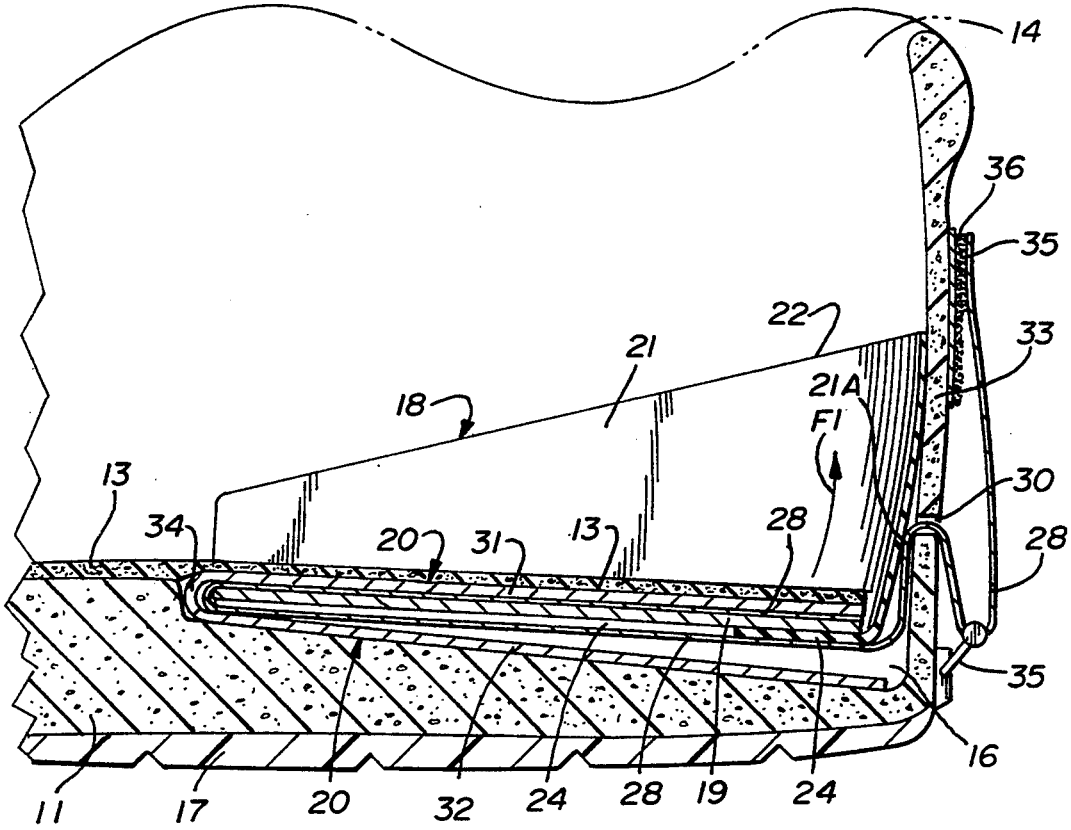
FIG. 4

ADJUSTABLE INTERNAL ENERGY RETURN SYSTEM FOR SHOES

BACKGROUND OF THE INVENTION

1. Technical Field

This device relates to athletic footwear that has internal spring heel configurations to impart improved performance and comfort to the user.

2. Description of Prior Art

Prior art devices of this type have relied on a variety of different spring element inclusions within the sole and heel portions of the shoe that use a variety of actual springs positioned within, see U.S. Pat. Nos. 2,555,654, 2,505,318; tempered steel bands, see U.S. Pat. Nos. 1,625,048, 4,592,153; and combination of spring wire and spring band elements, see U.S. Pat. Nos. 3,777,374, 4,492,046.

An elastic element is disclosed in U.S. Pat. No. 5,187,883 which has an internal construction having a non-yielding platform to which is attached an elastic strap element which is supported by an attachment to the non-yielding support from the heel portion of the shoe.

SUMMARY OF THE INVENTION

A self-contained adjustable resilient shoe support for use in athletic shoes and the like. The resilient support is positioned within the heel area of the shoe and can be adjusted for relative resiliency by a tension band that extends externally of the shoe. The resilient support is adjacent the shoe's sole utilizing the elongation of a resilient carriage-like element positioned evenly about the heel portion of the shoe.

DESCRIPTION OF THE DRAWINGS

FIG. 1 is an elevated cross-sectional view of a portion of a shoe assembly having the internal energy return system;

FIG. 4 is an elevated cross-sectional view of a portion of a shoe assembly showing the internal energy return system partially compressed.

DESCRIPTION OF THE PREFERRED EMBODIMENT

Figure 2:
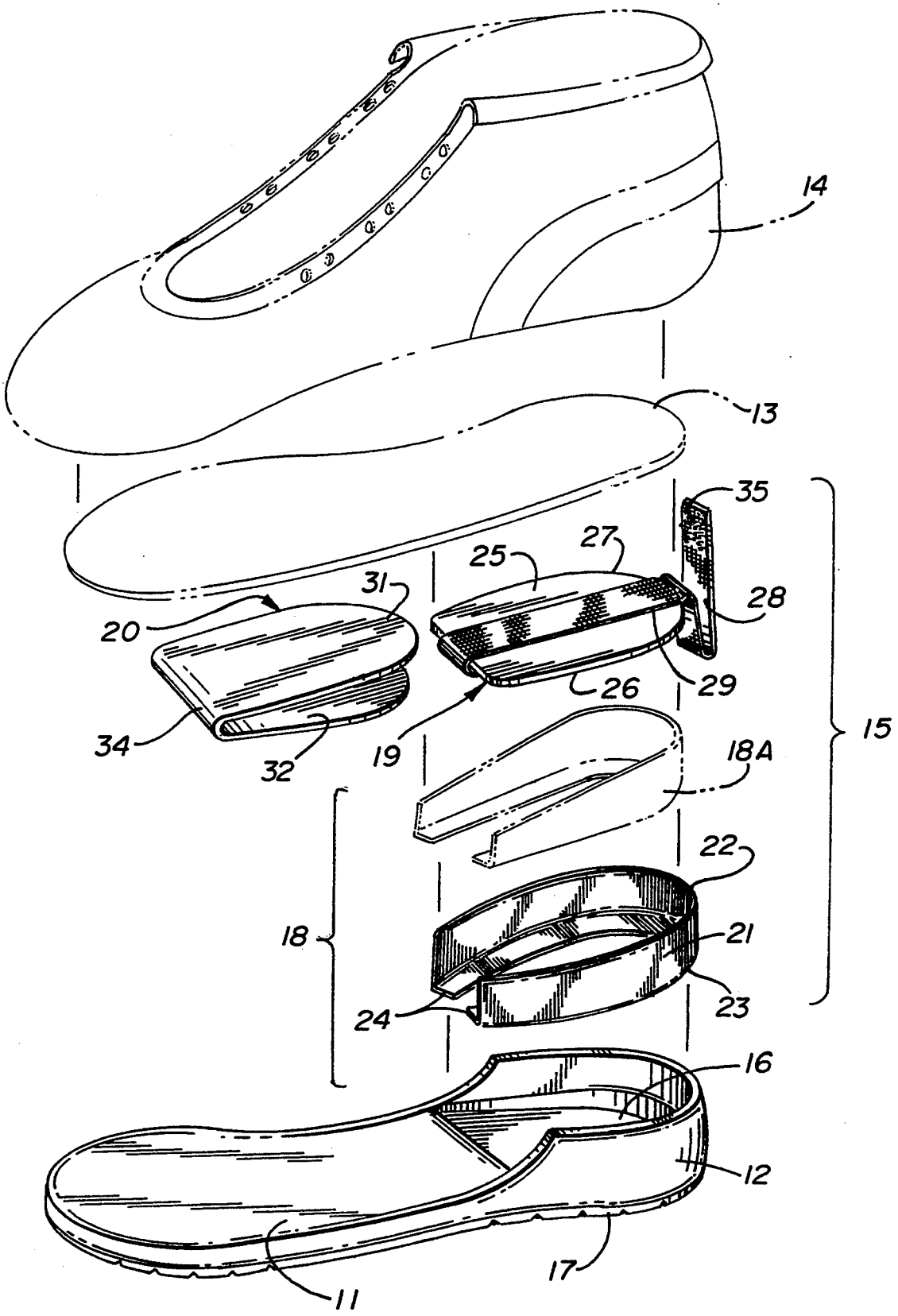
FIG. 2 is a perspective exploded view of a shoe assembly showing the internal energy return system.

Referring to FIGS. 1 and 2 of the drawings, a modified athletic shoe 10 (having simplified construction for illustration purposes) can be seen defining a sole 11, with a heel area 12 integral therewith and an inner sole 13 shown in broken lines. A shoe body 14 shown in FIG. 2 of the drawings in broken lines completes the general construction and in solid lines in FIG. 1 for illustration and orientation of the shoe construction related to a resilient shoe support assembly 15 positioned within. The sole 11 has a surface recess 16 in the heel area 12 and a tread portion 17 on its lower surface as will be well known to those skilled in the art. Referring now to FIG. 2 of the drawings, the shoe support assembly 15 has a primary resilient carriage 18 with a carriage liner 18A, (omitted in FIGS. 1, 3, and 4 for clarity) a support base 19 and a resilient hinge element 20. The resilient carriage 18 has a continuous arcuate sidewall 21 having a top edge 22 and a bottom edge portion 23 respectively. An integral flange 24 extends at right angles from said bottom edge portion 23 inwardly therefrom. The support base 19 is substantially planar with an upper surface 25 and a bottom surface 26 defining a arcuate perimeter edge portion at 27 that corresponds with the shape of the surface recess 16 in the heel area 12 as hereinbefore described.

An adjustable tension strap 28 is secured from the upper surface 25 at 29 extending longitudinally thereover and around the support base 19 unattached along its bottom surface 26 as best seen in FIGS. 1 and 4 of the drawings exiting the shoe through an opening 30 in the shoe body 14.

The hinge element 20 has a first and second flap portion 31 and 32 respectively. The first flap portion 31 is secured over the upper surface 25 of the support base 19 enclosing the tension strap 28 therebetween. The second flap portion 32 is secured within the recessed surface 16 of the sole 11 thus defining a hinge pivot point 34 therebetween. The integral flange 24 of the resilient carriage 18 is secured to support base 19 along its bottom surface 26.

Figure 3:
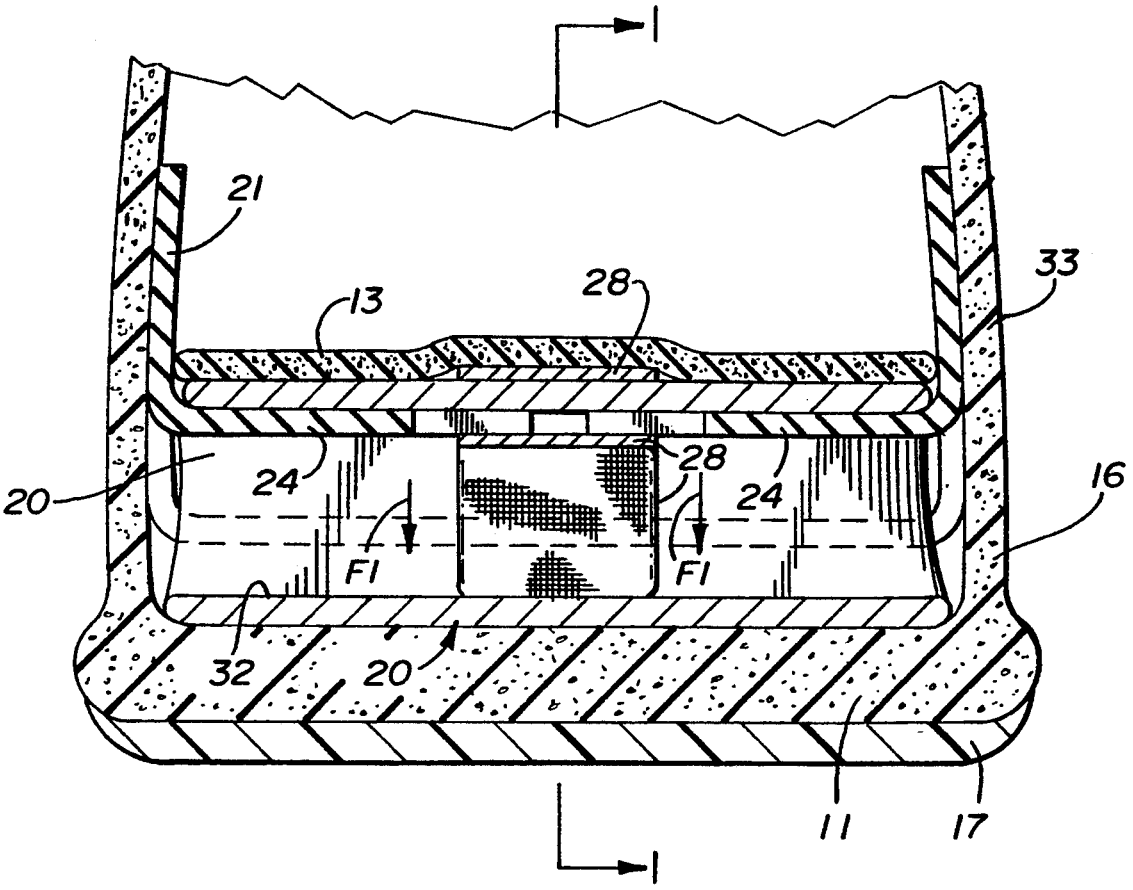
FIG. 3 is an elevated cross-section on lines 3—3 of FIG. 1.

In order for the resilient carriage 18 to impart a resilient rebound to the attached support base 19, the carriage's arcuate sidewall 21 is bonded along its outer surface inwardly from its top edge 22 to a reinforced sidewall at 33 of the shoe body 14 as best seen in FIG. 3 of the drawings.

As illustrated in FIGS. 1–4, the resilient carriage's arcuate sidewall 21 elongates at 21A under downward pressure on the support base 19. The surface recess 16 in the sole 11 permits vertical movement of the support base 19 and attached elements during cyclable loading of the shoe support assembly 15. The adjustability of the resilient rebound is controlled by the tension strap 28 that varies the recyclable movement of the support base 19. The tension strap 28 extends out of the shoe via the opening 30, passes over a guide bar 35 mounted on the sole 11. The tension strap 28 extends upwardly externally of the shoe along the reinforced wall 33 of the shoe body 14 and is adjustable secured thereto by opposed selectively interlocking VELCRO® brand fasteners 35 and 36 which are secured respectively to a reinforced wall 33 and the end of the tension strap 28.

By externally adjusting the relative length of the tension strap 28 (i.e. tension) within the shoe, the additional resiliency of the strap increases the force requirement to cause the stretching and associated elongation at 21A of the carriage's sidewall 21 without limiting the full range of motion. The shoe support assembly 15 can thus be adjusted to match the weight of the user or alternately the desired rebound imparted by the resilient carriage 18 and the resilient tension adjustment strap.

Once constructed, the shoe support assembly 15 is embedded between the sole's surface recess 16 and the inner sole 13. The carriage liner 18A prevents direct contact with the resilient carriage 18 that will elongate and stretch during use as hereinbefore described.

In use, the energy return function is illustrated in FIGS. 1–4 of the drawings wherein the potential energy is transformed into kinetic energy of the support base 19 as the resilient carriage 18 returns to its pre-elongation state as seen in FIG. 1 of the drawings. During the rebound of the support base 19 the attached resilient carriage 18 continues to exert a rebound force of the stored kinetic energy urging upwardly on the attached support base 19 in a controlled arcuate path rebound defined by the hereinbefore attached rubberized hinge element 20 from a partially compressed position as seen in FIG. 4 to a "rest" or rebound position shown in FIG. 1 which is evident either before or after the movement of the shoe support assembly 15.

The rebound force direction is indicated by the force arrow F1 in FIG. 4 and in broken lines in FIG. 3 providing a true biomechanical advantage during the energy rebound of the internal shoe support assembly 15.

Thus it will be seen that a new and useful internal shoe support assembly has been illustrated and described and it will be apparent to those skilled in the art that various changes and modifications may be made therein without departing from the spirit of the invention, therefore we claim:

1. Footwear including a sole, a heel portion and an upper and comprising: a support base for engagement with the user's heel within the heel portion, said support base being displaceable within said heel portion relative said upper shoe body, a tension strap engageable on and extending over said support base, a hinge element secured to said support base and to said heel portion, a resilient carriage extending between said upper shoe body and said support base, said resilient carriage has an arcuate sidewall with a depending right angular flange extending therefrom engaging said support base, whereby said resilient carriage is elongated about its arcuate wall in response to displacement to said support base towards said heel portion of said sole by the weight of the user's foot applied against said support base, said hinge element having a first portion and a second portion, said first portion of said hinge element engageable over a portion of said support base and said tension strap, and said second portion of said hinge element secured to said heel portion of said sole, means for adjustably securing said tension strap to said upper shoe body.

2. The internal shoe support of claim 1 wherein said means for adjustably securing said tension strap to said upper shoe body comprises a portion of said tension strap extending outwardly of said shoe, having releasable selectively interengaging fasteners on said respective upper shoe body and said tension strap's free end.

3. The internal shoe support of claim 1 wherein said heel portion of said sole has a surface recess for selective aligned registration of said support base during elongation of said resilient carriage.

4. The internal shoe support of claim 1 wherein said support base is substantially planar with a arcuate perimeter edge.

5. The internal shoe support of claim 1 wherein portions of said upper shoe construction extending from said heel portion is of a reinforced construction defining an area of increased thickness.

* * * * *